US005244110A

United States Patent [19]

Gerhard, deceased

[11] Patent Number: 5,244,110

[45] Date of Patent: Sep. 14, 1993

[54] HEATED TRANSPORT TANK

[75] Inventor: Helmut Gerhard, deceased, late of Weitefeld, Fed. Rep. of Germany, by Jan Gerhard - de Vries, Till Gerhard, heirs

[73] Assignee: Westerwalder Eisenwerk Gerhard GmbH, Fed. Rep. of Germany

[21] Appl. No.: 985,657

[22] Filed: Dec. 7, 1992

[30] Foreign Application Priority Data

Dec. 23, 1991 [DE] Fed. Rep. of Germany ... 9116014[U]

[51] Int. Cl.[5] ..... B65D 90/12

[52] U.S. Cl. ..... 220/562; 220/565; 220/1.5; 220/592; 220/500

[58] Field of Search ..... 220/562, 565, 1.5, 592, 220/DIG. 24, DIG. 25, 628, 627, 636, 647, 648, 400, 426, 445, 466, 469, 500

[56] References Cited

U.S. PATENT DOCUMENTS

| | | | |
|---|---|---|---|
| 156,211 | 10/1874 | Dreher | 220/627 |
| 2,226,713 | 12/1940 | Folmsbee | 220/DIG. 24 |
| 3,557,774 | 1/1971 | Kreis | 220/627 |
| 3,638,699 | 2/1972 | Hillinger | 220/647 |
| 3,938,689 | 2/1976 | de Munnik | 220/426 |
| 4,065,022 | 12/1977 | Cainaud | 220/1.5 |
| 4,370,998 | 2/1983 | Kimpara | 220/500 |
| 4,753,363 | 6/1988 | Gerhard . | |
| 4,934,553 | 6/1990 | McCarthy | 220/565 |
| 4,955,956 | 9/1990 | Gerhard | 220/562 |
| 5,054,645 | 10/1991 | Sharp | 220/469 |
| 5,064,091 | 11/1991 | Gerhard | 220/628 |

*Primary Examiner*—Allan N. Shoap
*Assistant Examiner*—S. Castellano
*Attorney, Agent, or Firm*—Evenson, McKeown, Edwards & Lenahan

[57] ABSTRACT

In a heated transport tank, the lower zone of the tank jacket 10 is surrounded by an outer shell 15 spaced from the jacket by socket-type projections 16 integrally formed in the shell 15. The outer shell 15, which forms a vapour flow chamber 20, extends throughout the axial length of the tank. At an intermediate location, where the tank is supported by a transverse bar 11 of a base structure via a transverse saddle 25, the socket-type projections 16 are reinforced by spacers inserted between the tank jacket 10 and the shell 15, each spacer being formed as a stack of comparatively thin annular discs. The individual discs are capable of conforming themselves to the local curvature of the tank jacket 10 and following instantaneous variations in curvature, thereby ensuring a uniform distribution of forces under all load conditions.

9 Claims, 2 Drawing Sheets

10
11
12
13
14
15
16
17
18
19
20
21
22
23
25
26
27
28
29
30
31
32
33
34
35
36
37
38

HEATED TRANSPORT TANK

BACKGROUND OF THE INVENTION

Transport tanks, which may be parts of tank containers, railway cistern wagons or tank trucks, often require a controlled temperature. It is specifically the lower tank zone that must be heated, for instance, when the tank is used for transporting masses which solidify at normal ambient temperatures, such as bitumen.

For heating by means of vapour, it has been known to form vapour channels welded under the lower zone of the tank and extending in the axial direction of the tank. The known design, however, requires a large amount of welding, causes welding stresses and results in a considerable increase of the tare weight.

In another design, a vapour space is formed by an outer shell which surrounds the lower zone of the tank jacket with a spacing therebetween. However, larger tanks must be supported by a container frame or vehicle frame not only in the region of the two tank ends but also at one or a plurality of intermediate locations in order to transmit vertical forces of the tank including its charge from the lower zone of the tank to the base structure of such frame.

A non-heated tank is known from U.S. Pat. No. 4,753,363, in which intermediate saddles are inserted between a reinforcing ring surrounding the tank jacket and a transverse bar of the base structure. In tanks having a heated lower zone, however, such reinforcing rings would interrupt the vapour chamber mentioned above. This causes portions of the tank jacket to be without heating and additionally requires measures to interconnect the separated vapour chamber portions. As a further essential disadvantage, any interruption of a vapour chamber formed by the outer shell would require additional welds.

SUMMARY OF THE INVENTION

It is an object of the invention to provide a transport tank in which particularly the lower zone is heated, which tank has a flow chamber for a heating medium—or generally a temperature control medium—extending through the entire axial length, yet can be efficiently supported by one or more transverse saddles provided at intermediate locations between the tank ends.

This object is met by a transport tank, the jacket of which has at least its lower zone covered by an outer shell extending in the longitudinal direction of the tank to form a flow chamber for a temperature control medium, and is supported by a base structure via at least one transverse saddle in an area intermediate the tank ends, wherein the shell is spaced from the tank jacket by projections formed integrally in the shell and projecting toward the tank jacket, the saddle having a portion abuts the outer shell and partially surrounds the same, and wherein at least some of the projections provided in the region of the saddle are surrounded by spacers each of which includes a plurality of annular discs stacked upon each other.

The projections, which keep the outer shell spaced from the tank jacket to form the flow chamber, are integrally formed in the outer shell and thus not sturdy enough in themselves to withstand the forces to be transmitted by a filled tank to the respective transverse saddle. They are therefore supported by spacers surrounding them. Each spacer comprises a stack of annular discs, with the height of the stack corresponding to the clear spacing between the tank jacket and the outer shell. The individual discs may be sufficiently thin and flexible to conform to the curvatures of the tank jacket and outer shell. This ensures the entire areas of the annular discs to be available for transmitting forces.

If the stack of annular discs were replaced by a single solid disc of the same overall thickness, such a disc could be pre-bent according to the curvature of the tank jacket prior to being installed; there would be the danger, however, that the disc is rotated in the mounting process, so that point stresses would be likely to occur. Moreover, a single solid disc could not follow deformations of the tank jacket as occur particularly in rough handling of the tank, in which case an efficient transmission of forces is particularly essential.

Forming the spacer as a stack of annular discs surrounding the projections is advantageous also from the mounting standpoint because the annular discs are centred by the projections and cannot become displaced in the course of time.

In a preferred embodiment, the stack includes at least three discs, with the outer discs adjacent the tank jacket and the shell being thinner and having larger diameters than the inner disc or discs of the stack. This is particularly suitable in view of a uniform transmission of forces from the tank jacket and, respectively, from the outer shell into the stack of annular discs. The discs are preferably produced as stamped parts and the outer discs of the stack are disposed with their rounded stamping edges facing the tank jacket and the shell, respectively. Smooth transitions in the distribution of forces are thus achieved at the outer edges of the discs.

In another advantageous embodiment of the invention, the projections are frusto-conical and have a circular hole in their faces abutting the tank jacket, the outer shell being welded to the tank jacket along the edge of the holes. The overall structure of the tank jacket and outer shell is thereby reinforced.

The saddle preferably includes a U-profile member, the centre web of which is curved so as to follow the curvature of the tank, and the legs of which are welded to a transverse bar of the base structure.

Further, a shell-shaped layer of wood may be inserted between the shell and the centre web of the U-profile member. This layer of wood results in an efficient insulation and also renders the supporting forces and the force transmission uniform. Further, a steel band may be inserted between the layer of wood and the shell, the band having lateral flange portions for retaining the layer of wood against displacement in the axial direction of the tank. An outward fold can be formed in each of the two circumferential end portions of the band, each fold having its end edge welded to the tank. These features are easy to realise in the manufacture and serve to secure the wooden layer, which is loosely inserted, against becoming displaced while at the same time permitting thermal expansions of the tank jacket and outer shell without the danger of stress cracks.

DETAILED DESCRIPTION OF THE PREFERRED EMBODIMENTS

Figures 1, 2:
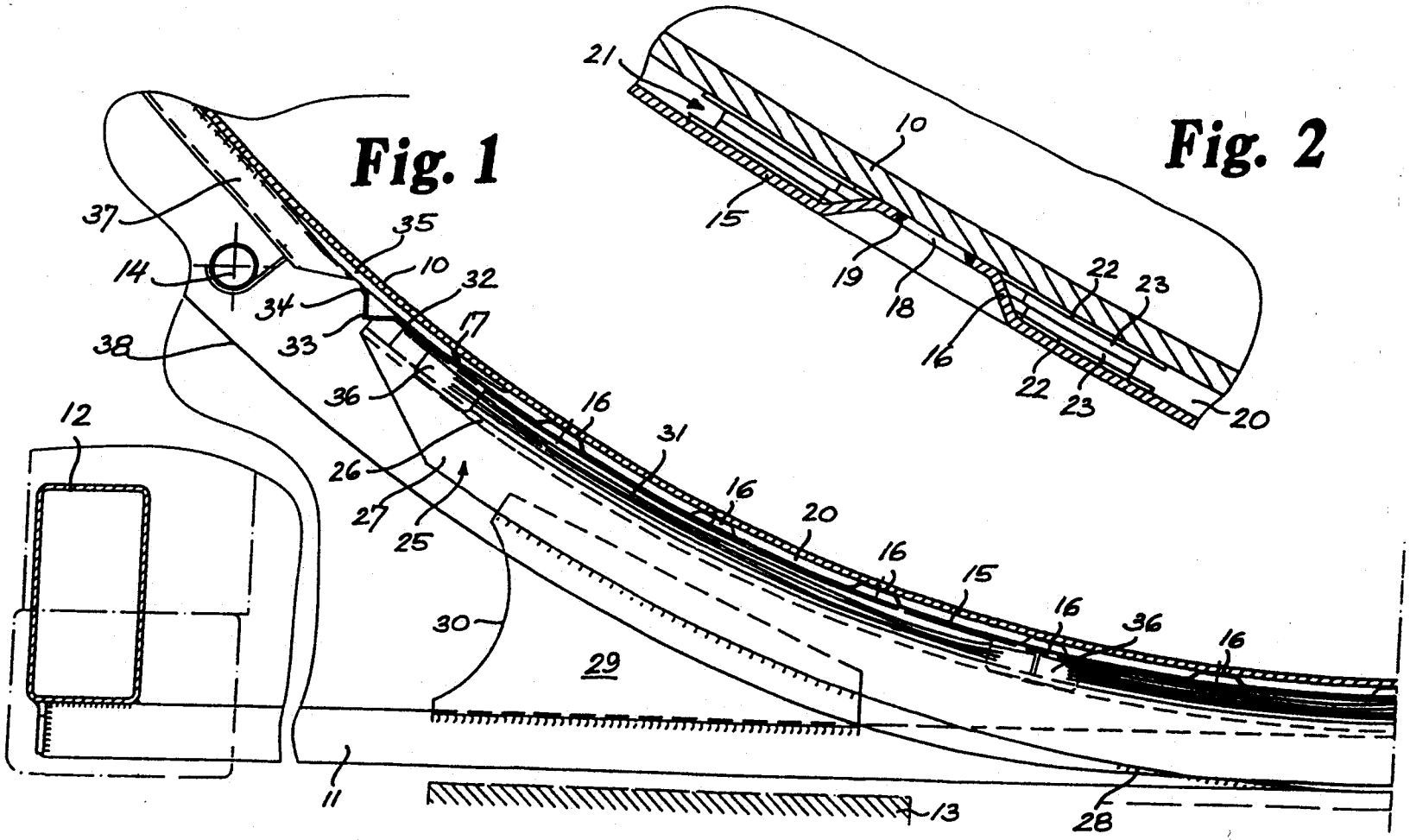
FIG. 1 is a section through half of the lower part of a tank container, taken perpendicularly to the tank axis.
FIG. 2 is an enlarged detail of FIG. 1.

FIG. 1 illustrates portions of the tank jacket 10 as well as of a transverse bar 11 and a longitudinal bar 12, which bars form part of the lower frame structure of a tank container. Indicated at 13 is one of the load supporting areas of a carrier vehicle as they are provided in accordance with ISO standards to support a container at locations intermediate its corner fittings.

In the lower zone, the tank jacket 10 is surrounded by an outer shell 15 which extends the entire axial length of the tank and bears on the tank jacket 10 by a plurality of frusto-conical socket-type projections 16 formed integrally in the shell 15, such as by punching. The shell 15 is made of, e.g., 2 mm sheet steel, with the integral projections 16 serving not only to provide a space with respect to the tank jacket 10 but also to reinforce of the outer shell 15 itself.

As indicated at 17, the shell 15 is welded along its entire periphery to the jacket 10. Further, at least some, or even all, of the projections 16 are each provided with a circular hole 18 in their surfaces of truncation and are connected to the tank jacket 10 by circular welds 19 formed along the edges of each hole 18. Thus, the shell 15 cooperates with the tank jacket 10 to form a closed flow chamber 20 through which vapour or some other heating medium is circulated via input and output lines, which are shown at 14. The flow chamber 20 has a clear height of 6 mm, for example.

The frusto-conical socket-type integral projection 16, which is shown in FIG. 2 on an enlarged scale, is surrounded by an annular spacer 21 which is formed of a stack of four separate annular discs 22, 23. The spacers 21 are not shown in FIG. 1 for the sake of clarity.

The outer two annular discs 22 of the stack, which are adjacent to the tank jacket 10 and the shell 15 respectively, each have a thickness of 1 mm and an outer diameter of 100 mm, whereas the inner two annular discs 23 have a thickness of 2 mm and an outer diameter of 90 mm. The discs 22, 23 are stamped parts, with the outer two discs 22 being so disposed that their stamping burrs face each other and the rounded stamping edges face the jacket 10 and the shell 15, respectively.

The stack of annular discs explained with reference to FIG. 2 has the following advantages over a spacer such as formed by a single solid disc:

(a) Due to their comparatively small thickness, the individual discs 22, 23 can adapt themselves exactly to the local curvatures of the tank jacket 10 and the outer shell 15.

(b) For the same reason, the individual annular discs can also follow such variations of curvature as occur in use due to changes in load, temperature or the like.

(c) Since the individual discs 22, 23 are not pre-bent, they can be mounted in any orientation.

(d) Due to their larger outer diameters and their smaller thicknesses, the outer discs 22 of the stack adjacent the jacket 10 and the shell 15 result in a particularly uniform distribution of forces without any abrupt changes in the transmission of forces from the tank to the saddle structure (described below).

(e) This effect is further improved by exploiting the rounded stamping edges of the outer discs 22.

(f) The inner diameter of the discs 22, 23 may be staggered in accordance with the conical shape of the projection 16, as shown in FIG. 2, so that each of them provides a maximum surface for the transmission of forces.

It may be useful during assembly to fix the individual discs 22, 23, such as by spot welding or gluing, to each other and to the inner surface of the shell 15 at a single spot each, without effecting a permanent rigid connection.

Figure 4:
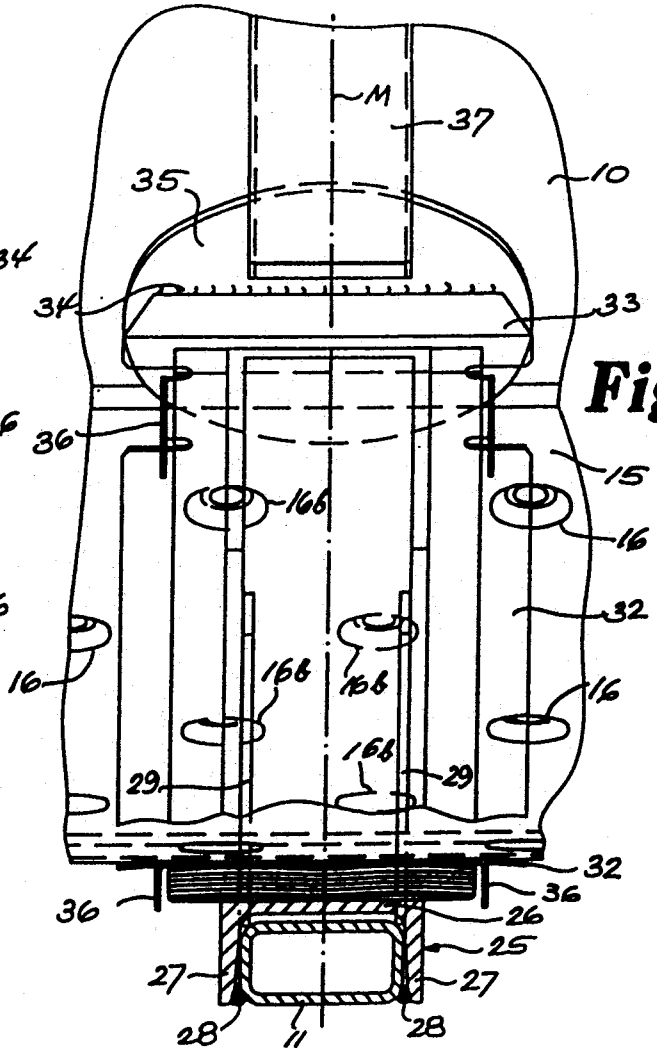
FIGS. 3 and 4 are lateral views, partly in section, of a portion of the lower tank zone shown in FIG. 1.
Figure 3:
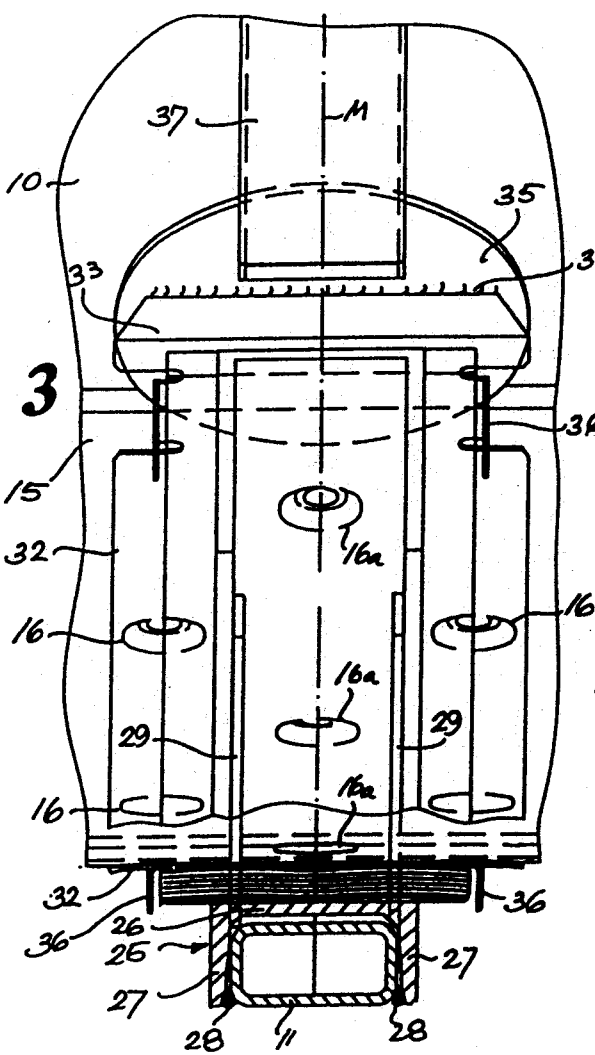

The above-described tank, which has its entire lower zone covered by a continuous outer shell 15 for forming a vapour flow chamber 20, is supported by a transverse bar of the base structure through at least one transverse saddle at an intermediate location between the two tank ends, one such transverse bar being shown at 11 in FIGS. 1, 3 and 4.

The transverse saddle includes a U-profile member 25 the centre web 26 of which is circularly bent about the tank axis so as to follow the curvature of the tank. The two legs 27 of the U-profile member 25 straddle the transverse bar 11 and are welded directly thereto in the lowermost region of the tank as shown at 28 in FIGS. 1, 3 and 4. Above each load supporting area 13, where the tank is above the transverse bar due to its curvature, the U-profile member 25 is connected to the transverse bar 11 by a pair of supporting plates 29 which have their inner surfaces welded to the legs 27 and to the upper edges of the transverse bar 11. At its edge remote from the lower centre of the tank, each supporting plate 29 is provided with a round cut-out 30 to avoid peak stresses.

A layer of wood 31 having a thickness of approximately 30 mm is inserted between the centre web 26 of the U-profile member 25 and the shell 15. The layer 31 consists of three separate pieces shells of plywood that are pre-bent in accordance with the curvature of the tank and abut each other in the circumferential direction.

Further, a band 32 of 2 mm stainless steel is disposed between the wooden layer 31 and the outer surface of the shell 15. The band 32 has an outward fold 33 at each of its circumferential ends. The outermost edge of the band 32 is welded, as indicated at 34 in FIGS. 1, 3 and 4, to a circular reinforcing plate 35 which is in turn welded to the tank jacket 10. At the locations, where the individual pieces of the wooden layer 31 terminate, the band 32 is further provided with lateral, outwardly flanged portions 36 to prevent the loosely inserted pieces of wood from becoming displaced in the axial direction of the tank. The folds 33 serve to compensate differences in length between the tank jacket 10 and the band 32, thus to avoid stress, and further provide an abutment that prevents the wooden pieces from moving in the circumferential direction.

As a result of its somewhat soft-plastic structure, the wooden layer 31 not only effects an insulation between the outer shell 15 confining the vapour flow chamber 20, and the U-profile member 25 of the transverse saddle, but also ensures a uniform distribution of the forces transmitted between the tank and the saddle. To this end, the width of the wooden layer 31 is approximately 150 mm and thus substantially larger than the width of the centre web 26 of the U-profile member 25, which is 100 mm for example.

The embodiments of FIGS. 3 and 4 differ from each other with respect to the (accidental) alignment of the socket-type projections 16 provided in the outer shell 15 relative to the position of the transverse saddle. In the arrangement of FIG. 3, only the projections 16*a* that are situated in the centre plane M of the saddle need be provided with spacers 21 such as shown in FIG. 2. For the projections situated outside the saddle, no such spacers are required, and are not desired because they reduce the flow chamber.

In the arrangement of FIG. 4, no projections 16 are aligned with the centre plane M of the saddle. In this case, all, or at least a plurality, of the projections **16*b* are reinforced by spacers 21 according to FIG. 2**.

In the embodiments described above, the outer shell 15, which surrounds the lower zone of the tank, extends through an angle of, e.g. 80° about the tank axis. The rest of the tank circumference is surrounded by a conventional reinforcing ring 37, the chamfered ends of which are welded to the reinforcing plates 35, just as are the ends of the band 32, to avoid peak stresses on the tank jacket 10 and on the shell 15.

FIG. 1 also shows an insulation surrounding the entire tank and having an outer skin 38.

We claim:

1. A transport tank having a jacket, an outer shell extending in the longitudinal direction of the tank and covering at least a lower zone of said jacket to form a flow chamber for a temperature control medium, and at least one saddle extending generally transversely of said longitudinal direction for supporting the tank on a base structure in an intermediate area of the tank, said shell being spaced from said jacket by projections formed integrally in the shell and projecting toward said jacket, at least some of the projections provided in the region of the saddle being surrounded by spacers each of which includes a stack of annular discs.

2. The transport tank of claim 1, wherein said stack includes at least three of said discs, outer discs adjacent the tank jacket and the shell being thinner than an inner disc of the stack.

3. The transport claim 1, wherein said stack includes at least three of said discs, outer discs adjacent the tank jacket and the shell having larger diameters than an inner disc of the stack.

4. The transport tank of claim 1, wherein said discs are stamped parts having rounded edges and outer discs of the stack which are adjacent the tank jacket and the shell and are disposed with said rounded edges facing said jacket and said shell, respectively.

5. The transport tank of claim 1, wherein said projections are frusto-conical and each projection having a hole in the face abutting said jacket, said shell being welded to said jacket along the edge of said holes.

6. The transport tank of claim 1, wherein said saddle includes a U-profile member having a center web which is curved so as to follow the curvature of the tank and legs which are welded to a transverse bar of said base structure.

7. The transport tank of claim 6, including a layer of wood inserted between said shell and the center web of said U-profile member.

8. The transport tank of claim 7, including a steel band inserted between said layer of wood and said shell, said band having lateral flange portions for retaining said layer of wood against displacement in the longitudinal direction of the tank.

9. The transport tank of claim 8, including an outward fold formed in each of two circumferential end portions of the band, each fold having an edge welded to the tank.

* * * * *